US010458428B2

(12) United States Patent
Drozdenko et al.

(10) Patent No.: US 10,458,428 B2
(45) Date of Patent: Oct. 29, 2019

(54) FAN BLADES AND MANUFACTURE METHODS

(71) Applicant: United Technologies Corporation, Hartford, CT (US)

(72) Inventors: Lee M. Drozdenko, Bristol, CT (US); James O. Hansen, Glastonbury, CT (US); Jesse C. Meyer, Colchester, CT (US); John J. Marcin, Jr., Marlborough, CT (US); Robert M. Shemenski, Broad Brook, CT (US); Scot A. Webb, Gales Ferry, CT (US); Brandon A. Gates, DeWitt, MI (US); Michael A. Morden, Holt, MI (US)

(73) Assignee: United Technologies Corporation, Farmington, CT (US)

( * ) Notice: Subject to any disclaimer, the term of this patent is extended or adjusted under 35 U.S.C. 154(b) by 718 days.

(21) Appl. No.: 14/917,476

(22) PCT Filed: Aug. 4, 2014

(86) PCT No.: PCT/US2014/049586

§ 371 (c)(1),
(2) Date: Mar. 8, 2016

(87) PCT Pub. No.: WO2015/034612

PCT Pub. Date: Mar. 12, 2015

(65) Prior Publication Data

US 2016/0222978 A1 Aug. 4, 2016

Related U.S. Application Data

(60) Provisional application No. 61/875,628, filed on Sep. 9, 2013.

(51) Int. Cl.
*F04D 29/38* (2006.01)
*F01D 5/28* (2006.01)
(Continued)

(52) U.S. Cl.
CPC ..... *F04D 29/388* (2013.01); *F01D 5/147* (2013.01); *F01D 5/282* (2013.01); *F01D 5/288* (2013.01);
(Continued)

(58) Field of Classification Search
CPC ..... F04D 29/02; F04D 29/023; F04D 29/64; F04D 29/644; F04D 29/38; F04D 29/388;
(Continued)

(56) References Cited

U.S. PATENT DOCUMENTS 2,431,184 A * 11/1947 Martin ..... B64C 11/205 416/224
3,628,890 A * 12/1971 Sayre ..... F01D 5/282 416/220 R (Continued)

FOREIGN PATENT DOCUMENTS

EP 2348192 A2 7/2011
EP 3037675 A1 6/2016

OTHER PUBLICATIONS

Data Sheet-Product Information, received Jul. 9, 2013 from http://bgf.com/FabricSearch/DataSheet.asp?FabricID=244&MeasurementFormat=English, BGE Industries, Inc., Greensboro, North Carolina.

(Continued)

*Primary Examiner* — Carlos A Rivera
*Assistant Examiner* — Wayne A Lambert
(74) *Attorney, Agent, or Firm* — Bachman & LaPointe, P.C.

(57) ABSTRACT

An airfoil member (100) comprising has a substrate (120) along at least a portion of an airfoil (102) of the airfoil member. A sheath (122) has a channel (144) receiving a portion (160) of the substrate. A plurality of separate spacers
(Continued)

(320; 380; 400) are between the sheath and the substrate and have a plurality of gaps between the spacers.

21 Claims, 11 Drawing Sheets

(51) Int. Cl.
*F01D 5/14* (2006.01)
*F04D 29/02* (2006.01)
*F04D 29/32* (2006.01)
*F04D 29/64* (2006.01)

(52) U.S. Cl.
CPC ..... *F04D 29/023* (2013.01); *F04D 29/324* (2013.01); *F04D 29/325* (2013.01); *F04D 29/644* (2013.01); *F05D 2220/36* (2013.01); *F05D 2240/303* (2013.01); *F05D 2300/173* (2013.01); *F05D 2300/174* (2013.01); *F05D 2300/433* (2013.01); *F05D 2300/614* (2013.01)

(58) Field of Classification Search
CPC ..... F04D 29/324; F04D 29/325; F01D 5/28; F01D 5/282; F01D 5/288; F01D 5/14; F01D 5/147; F05D 2300/6033; F05D 2300/173; F05D 2300/174; F05D 2300/614; F05D 2300/433; F05D 2220/36; F05D 2240/303; F05D 2260/95
See application file for complete search history.

(56) References Cited

U.S. PATENT DOCUMENTS 3,762,835 A * 10/1973 Carlson ..... B29C 70/04 416/224
3,892,612 A * 7/1975 Carlson ..... F01D 5/282 156/150
4,006,999 A * 2/1977 Brantley ..... F01D 5/282 416/224
4,010,530 A * 3/1977 Delgrosso ..... B23K 20/00 228/160
4,396,349 A * 8/1983 Hueber ..... F01D 5/284 415/115
4,789,304 A * 12/1988 Gustafson ..... B64C 11/26 416/224
4,856,162 A * 8/1989 Graff ..... B23K 20/02 29/889.6
5,174,024 A 12/1992 Sterrett
5,279,892 A * 1/1994 Baldwin ..... B29C 70/08 442/206
5,486,096 A * 1/1996 Hertel ..... B64C 27/46 156/313
5,591,009 A * 1/1997 Mannava ..... C21D 10/005 148/525
5,725,354 A * 3/1998 Wadia ..... F01D 5/147 416/224
5,881,972 A * 3/1999 Smith ..... B64C 11/205 244/121
5,887,332 A * 3/1999 Champenois ..... B29C 37/0082 264/258
5,908,285 A * 6/1999 Graff ..... C25D 1/10 205/67
6,471,485 B1 * 10/2002 Rossmann ..... F01D 5/147 416/223 A
6,607,358 B2 * 8/2003 Finn ..... B23P 15/04 416/224
7,182,581 B2 * 2/2007 Bostanjoglo ..... C23C 28/3215 416/229 A
7,510,778 B2 * 3/2009 Bernard ..... B23P 15/04 416/224
7,575,417 B2 * 8/2009 Finn ..... F01D 5/147 416/230
7,736,130 B2 * 6/2010 Schilling ..... B64C 11/205 416/224
7,794,197 B2 * 9/2010 Thompson ..... F01D 5/147 415/9
8,033,789 B2 * 10/2011 Read ..... F01D 5/26 416/230
8,061,997 B2 * 11/2011 Le Hong ..... F01D 5/147 416/205
8,109,734 B2 * 2/2012 Backhouse ..... F01D 5/147 244/123.1
8,146,865 B2 * 4/2012 Sanchez-Brunete Ivarez ..... B64C 3/24 244/123.1
8,807,931 B2 * 8/2014 Roberts ..... F01D 5/147 415/200
2003/0071019 A1 * 4/2003 Cline ..... C23F 1/26 216/109
2007/0092379 A1 * 4/2007 Coupe ..... B29B 11/16 416/241 R
2008/0075601 A1 * 3/2008 Giusti ..... F01D 5/147 416/229 A
2009/0142193 A1 6/2009 Bech
2010/0008788 A1 * 1/2010 Barbee ..... F01D 5/288 416/224
2010/0254821 A1 10/2010 Parkin et al.
2011/0033308 A1 2/2011 Huth et al.
2011/0038732 A1 * 2/2011 Huth ..... B29C 70/24 416/229 A
2011/0049297 A1 3/2011 Jevons et al.
2011/0182740 A1 * 7/2011 Klinetob ..... F01D 5/147 416/224
2011/0194941 A1 * 8/2011 Parkin ..... B29C 70/48 416/224
2011/0211967 A1 9/2011 Deal et al.
2011/0229334 A1 9/2011 Alexander
2012/0134839 A1 5/2012 Parkin et al.
2012/0156049 A1 6/2012 Hong
2012/0263596 A1 * 10/2012 Evans ..... F01D 5/28 416/193 A
2012/0301292 A1 11/2012 Deal et al.
2013/0004323 A1 1/2013 Hansen et al.
2013/0089428 A1 4/2013 Hottier et al.
2013/0156588 A1 6/2013 Murdock et al.
2013/0177440 A1 * 7/2013 Zhang ..... C04B 41/52 416/241 R
2013/0185938 A1 * 7/2013 Dambrine ..... B21D 53/78 29/889.71
2013/0186507 A1 * 7/2013 Godon ..... B64C 11/26 139/425 R
2013/0219717 A1 * 8/2013 Dambrine ..... B21D 53/78 29/889.7
2013/0312261 A1 * 11/2013 Godon ..... B21D 53/78 29/889.71
2013/0333214 A1 * 12/2013 Godon ..... B21D 22/022 29/889.7
2013/0333215 A1 * 12/2013 Godon ..... B23K 20/021 29/889.71
2014/0193271 A1 * 7/2014 Dudon ..... B23P 15/04 416/241 R

OTHER PUBLICATIONS

Advanced Composites, High Performance Fabrics for Structural Integrity, Dec. 2008, BGF Industries, Inc., Greensboro, North Carolina.
3M Scotch-Weld Structural Adhesive Film AF 3109-2, May 2002, 3M, St. Paul, Minnesota.
Customer Acceptance Standard: Fiberglass B/C Sewing Thread, Jun. 14, 2004, AGY Holding Corp., Aiken, South Carolina.
Customer Acceptance Standard: Fiberglass Continuous Filament Yarn for the Weaving Industry, Jul. 8, 2013, AGY Holding Corp., Aiken, South Carolina.
Hysol EA 9689 Epoxy Film Adhesive, May 14, 2007, Henkel Corporation, Bay Point, California.
International Search Report for PCT/US2014/049576, dated May 27, 2015.

(56) References Cited

OTHER PUBLICATIONS

International Search Report for PCT/US2014/049586, dated Nov. 24, 2014.
European Search Report dated Mar. 14, 2017 for European Patent Application No. 14843035.8.

* cited by examiner

FAN BLADES AND MANUFACTURE METHODS

CROSS REFERENCE TO RELATED APPLICATION

Benefit is claimed of U.S. Patent Application Ser. No. 61/875,628, filed Sep. 9, 2013, and entitled "Fan Blades and Manufacture Methods", the disclosure of which is incorporated by reference herein in its entirety as if set forth at length.

BACKGROUND

The disclosure relates to turbine engine. More particularly, the disclosure relates to bonding galvanically dissimilar sheaths and substrates.

In a number of situations in gas turbine engine cold section components such as blades and vanes, a protective sheath is used to protect a substrate or main body of the component. Such sheaths may offer protection from foreign object damage or wear to leading edge and/or trailing edge portions of airfoils. In such situations, the sheath forms a limited portion of the airfoil contour with the main body providing the rest.

In some examples, the sheath may be of a more expensive material than the main body (e.g., a titanium alloy sheath on an aluminum alloy body where the aluminum alloy is used for cost reasons). In others, the sheath may be of a less expensive material (e.g., when the body is of a very light material with little impact resistance (e.g., a carbon fiber composite)).

US patent application publications 20110211967 and 20120301292 disclose a sheath bonded to blade substrate using a scrim and epoxy. The scrim and epoxy may galvanically isolate the sheath from the substrate to prevent corrosion.

SUMMARY

One aspect of the disclosure involves an airfoil member comprising: a substrate along at least a portion of an airfoil of the airfoil member; a sheath having a channel receiving a portion of the substrate; and a plurality of separate spacers between the sheath and the substrate and having a plurality of gaps between the spacers.

A further embodiment may additionally and/or alternatively include the airfoil member being a blade.

A further embodiment may additionally and/or alternatively include the plurality of separate spacers comprising a plurality of polymeric elements.

A further embodiment may additionally and/or alternatively include the plurality of separate spacers comprising a plurality of ceramic elements.

A further embodiment may additionally and/or alternatively include the plurality of separate spacers being distributed in a plurality of rows.

A further embodiment may additionally and/or alternatively include the plurality of rows comprising a leading edge row, a suction side row and a pressure side row.

A further embodiment may additionally and/or alternatively include: the substrate being a first metallic material; and the sheath being a second metallic material different from the first metallic material.

A further embodiment may additionally and/or alternatively include: the first metallic material being an aluminum alloy; and the second metallic material being a titanium alloy.

A further embodiment may additionally and/or alternatively include there being no mesh scrim between the substrate and sheath.

A further embodiment may additionally and/or alternatively include the spacers each comprising a fibrous sheet.

A further embodiment may additionally and/or alternatively include the spacers each comprising aramid fiber or polyamide fiber.

A further embodiment may additionally and/or alternatively include the aramid fiber or polyamide fiber being formed as a knit sheet.

A further embodiment may additionally and/or alternatively include the spacers having a characteristic thickness of 0.15 mm to 0.80 mm.

A further embodiment may additionally and/or alternatively include the airfoil member being a fan blade.

A further embodiment may additionally and/or alternatively include the sheath forming a leading edge of the airfoil.

A further embodiment may additionally and/or alternatively include a method for manufacturing the airfoil member, the method comprising: applying an adhesive to the substrate or the sheath; applying the spacers to the adhesive; and applying the sheath to the substrate.

A further embodiment may additionally and/or alternatively include the spacers being applied sequentially.

A further embodiment may additionally and/or alternatively include the applying of the sheath leaving end portions of the spacers protruding along the substrate.

A further embodiment may additionally and/or alternatively include cutting off the end portions.

A further embodiment may additionally and/or alternatively include a turbine engine comprising the airfoil member as a fan blade.

A further embodiment may additionally and/or alternatively include the sheath forming a leading edge of the airfoil.

Another aspect of the disclosure involves a airfoil member comprising: a substrate along at least a portion of an airfoil of the airfoil member; a sheath having a channel receiving a portion of the substrate; and one or more spacers locally between a base of the channel and an edge of the portion of the substrate.

Another aspect of the disclosure involves a airfoil member comprising: substrate along at least a portion of an airfoil of the airfoil member; a sheath having a channel receiving a portion of the substrate; and one or more spacers between the channel and the portion of the substrate and having portions spanwise spaced-apart by gaps of at least 10 mm.

A further embodiment may additionally and/or alternatively include the spacers each comprising a fibrous sheet and each of the gaps are between respective edges of two of said sheets.

The details of one or more embodiments are set forth in the accompanying drawings and the description below. Other features, objects, and advantages will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
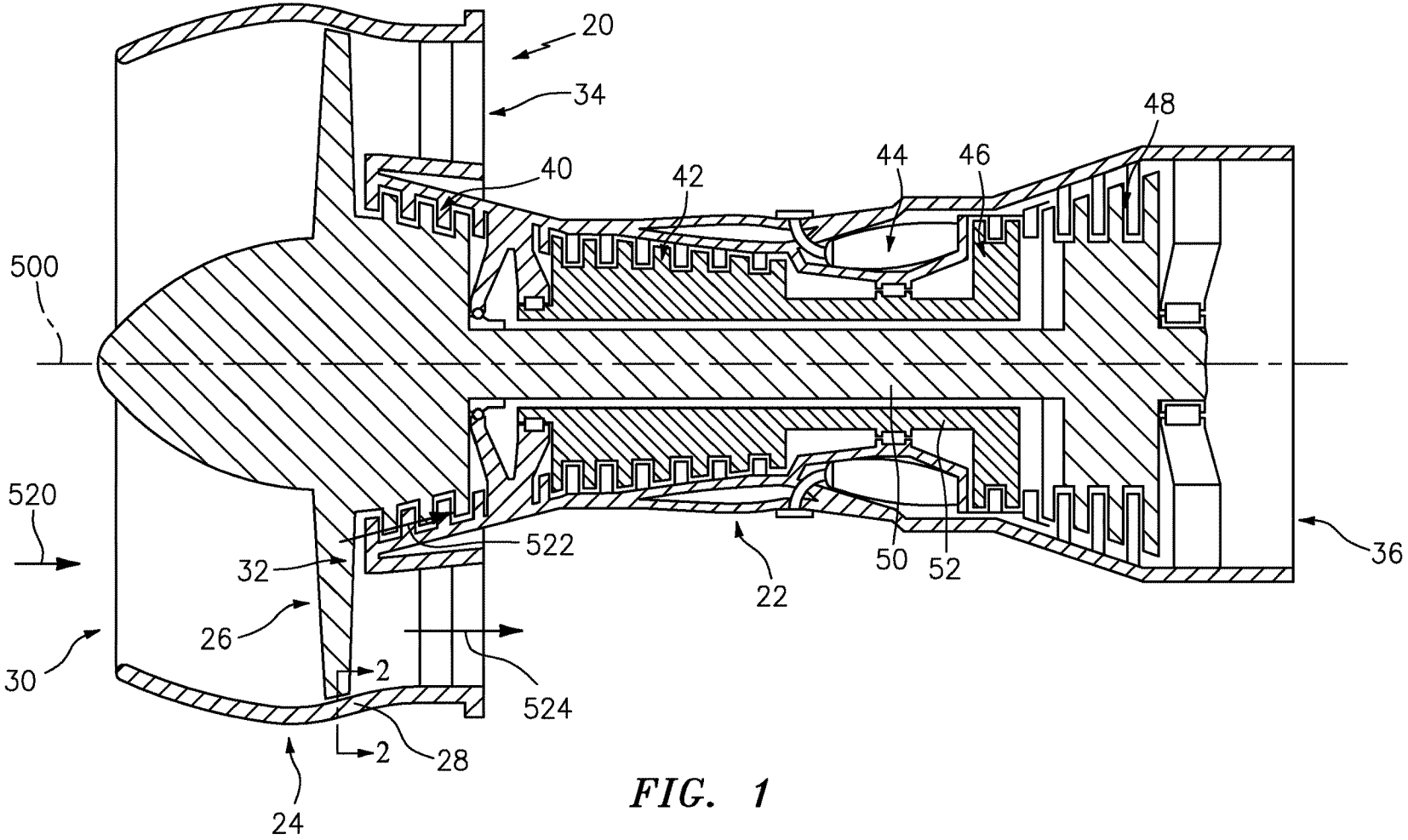
FIG. 1 is a partially schematic half-sectional view of a turbofan engine.

FIG. 1 shows a gas turbine engine 20 having an engine case 22 surrounding a centerline or central longitudinal axis 500. An exemplary gas turbine engine is a turbofan engine having a fan section 24 including a fan 26 within a fan case 28. The exemplary engine includes an inlet 30 at an upstream end of the fan case receiving an inlet flow along an inlet flowpath 520. The fan 26 has one or more stages 32 of fan blades. Downstream of the fan blades, the flowpath 520 splits into an inboard portion 522 being a core flowpath and passing through a core of the engine and an outboard portion 524 being a bypass flowpath exiting an outlet 34 of the fan case.

The core flowpath 522 proceeds downstream to an engine outlet 36 through one or more compressor sections, a combustor, and one or more turbine sections. The exemplary engine has two axial compressor sections and two axial turbine sections, although other configurations are equally applicable. From upstream to downstream there is a low pressure compressor section (LPC) 40, a high pressure compressor section (HPC) 42, a combustor section 44, a high pressure turbine section (HPT) 46, and a low pressure turbine section (LPT) 48. Each of the LPC, HPC, HPT, and LPT comprises one or more stages of blades which may be interspersed with one or more stages of stator vanes.

In the exemplary engine, the blade stages of the LPC and LPT are part of a low pressure spool mounted for rotation about the axis 500. The exemplary low pressure spool includes a shaft (low pressure shaft) 50 which couples the blade stages of the LPT to those of the LPC and allows the LPT to drive rotation of the LPC. In the exemplary engine, the shaft 50 also drives the fan. In the exemplary implementation, the fan is driven via a transmission (not shown, e.g., a fan gear drive system such as an epicyclic transmission) to allow the fan to rotate at a lower speed than the low pressure shaft.

The exemplary engine further includes a high pressure shaft 52 mounted for rotation about the axis 500 and coupling the blade stages of the HPT to those of the HPC to allow the HPT to drive rotation of the HPC. In the combustor 44, fuel is introduced to compressed air from the HPC and combusted to produce a high pressure gas which, in turn, is expanded in the turbine sections to extract energy and drive rotation of the respective turbine sections and their associated compressor sections (to provide the compressed air to the combustor) and fan.

Figure 2:
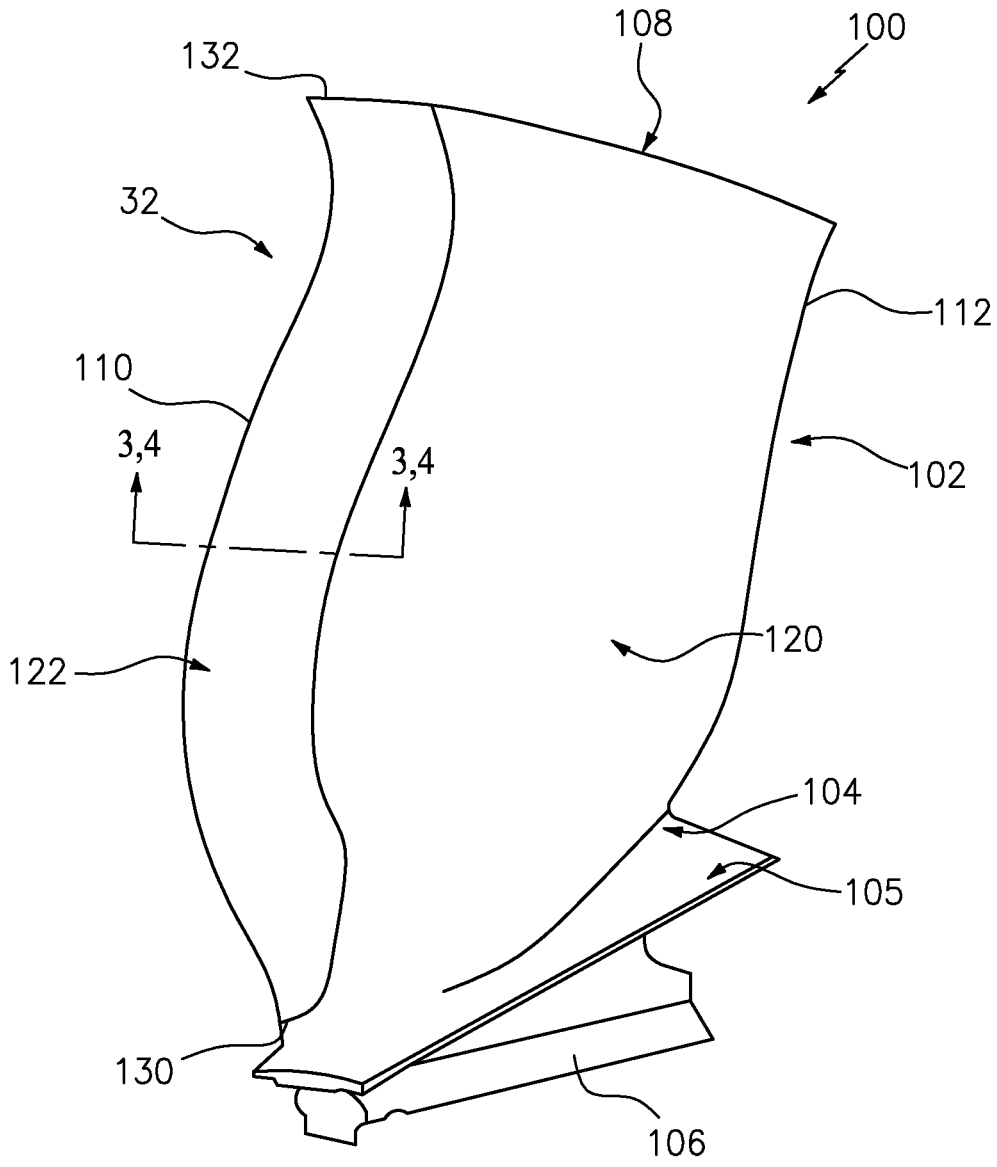
FIG. 2 is a view of a fan blade of the engine of FIG. 1.

FIG. 2 shows a fan blade 100. The blade has an airfoil 102 extending spanwise outward from an inboard end 104 at a platform 105 or an attachment root 106 to a tip 108 (e.g., an unshrouded or "free" tip). The airfoil has a leading edge 110, trailing edge 112, pressure side 114 (FIG. 3) and suction side 116.

In the exemplary blade, a metallic member forms a main body or substrate 120 of the airfoil and overall blade to which a leading edge sheath 122 is secured. Exemplary main bodies 120 are aluminum-based and exemplary leading edge sheathes are titanium-based. Such materials are disclosed in US patent application publications 20110211967 and 20120301292. Alternative main body materials include carbon fiber composites. However, other configurations of blades and other articles are possible. Other airfoil articles include other cold section components of the engine including fan inlet guide vanes, fan exit guide vanes, compressor blades, and compressor vanes or other cold section vanes or struts.

Figure 3:
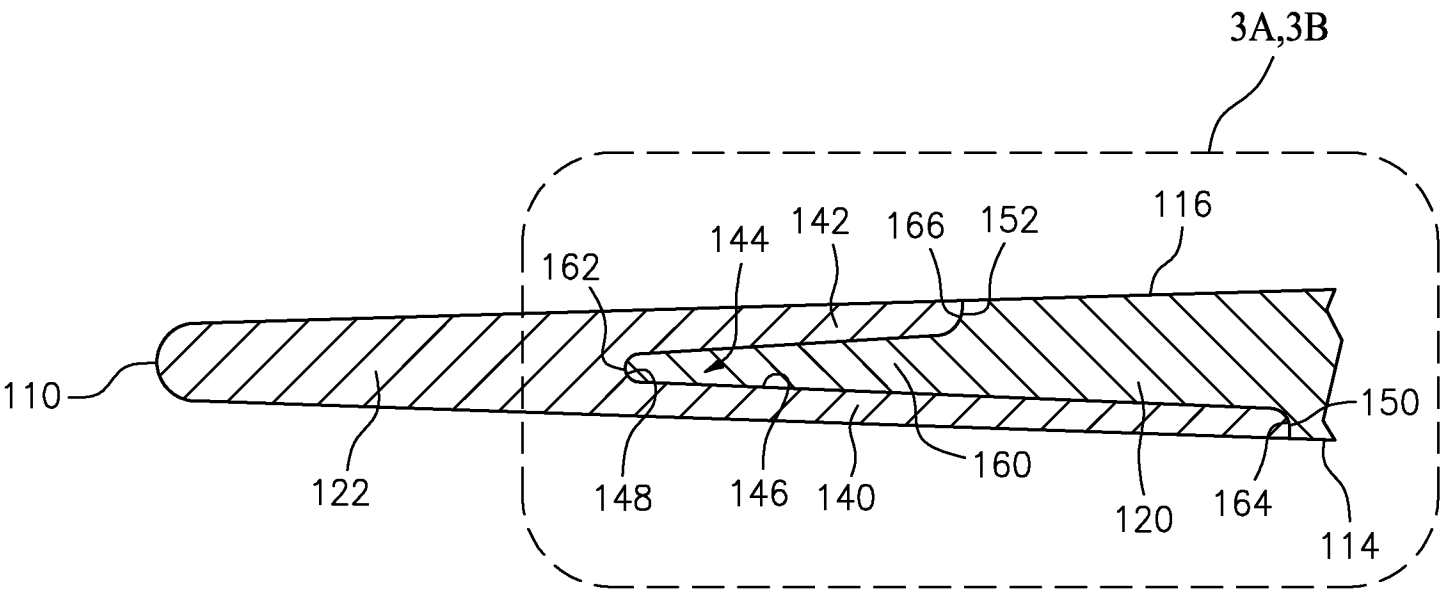
FIG. 3 is a partial sectional view of the blade of FIG. 2, taken along line 3-3.

FIG. 3 is a sectional view of a leading portion of the airfoil of the blade of FIG. 2. The sheath 122 is formed as a channel structure extending from an inboard or rootward end 130 to an outboard or tipward end 132 having portions 140 and 142 respectively along the pressure side and suction side. The portions 140 and 142 are on opposite sides of a channel 144 formed by an inner surface 146 of the sheath and extending downstream from a base 148. The portions 140 and 142 respectively extend downstream to downstream edges 150 and 152.

The sheath 122, in its channel 144, receives a leading portion 160 of the main body 120. The exemplary leading portion 160 extends downstream from a leading edge 162 to respective pressure side and suction side shoulders 164 and 166. The shoulders separate the leading portion from respective portions of the airfoil pressure and suction side surfaces along the main body 120.

Figure 3A:
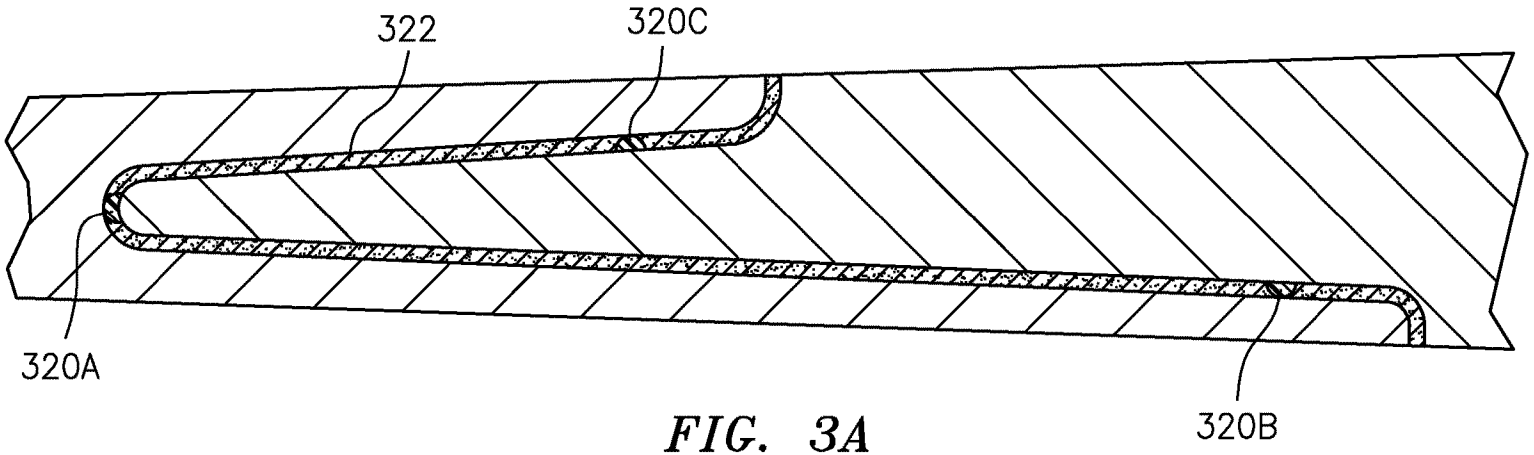
FIG. 3A is an enlarged view of a joint of the blade of FIG. 3.
Figure 4:
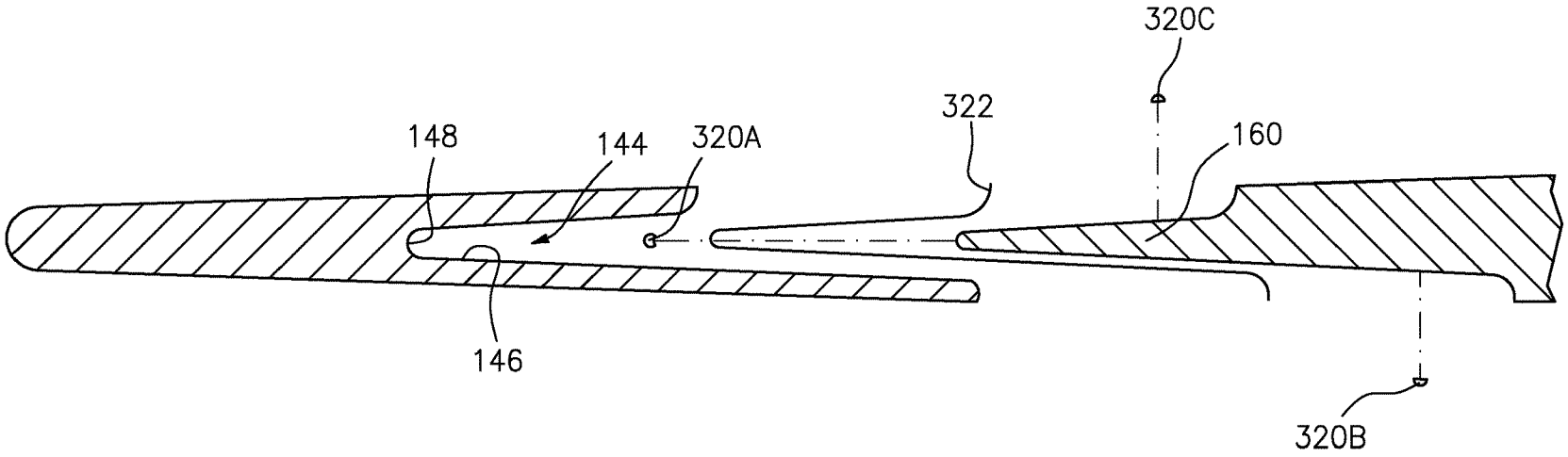
FIG. 4 is an exploded sectional view of the blade of FIG. 3 showing manufacturing features.

To galvanically isolate the sheath 122 from the main body 120, spacers 320A-C (collectively 320) and an electrically non-conductive adhesive 322 (FIGS. 3A, 4, and 5) separate the leading portion 160 from the sheath inner surface 146. Whereas the planform of the prior art scrim covers essentially the entire planform of the joint along the sheath channel 144, the exemplary spacers have more limited planform.

In the exemplary embodiment, the spacers 320 are shown as separate elements arranged in a plurality of rows. The exemplary implementation includes three rows. A first row of the spacers 320A is located between the leading edge 162 of the leading portion 160 and the channel base 148. The second row of spacers 320B extends spanwise between the pressure side portion 140 of the sheath and the adjacent face of the leading portion 160. The third row of spacers 320C extends spanwise between the sheath suction side portion 142 and the adjacent surface of the leading portion 160.

Figure 5:
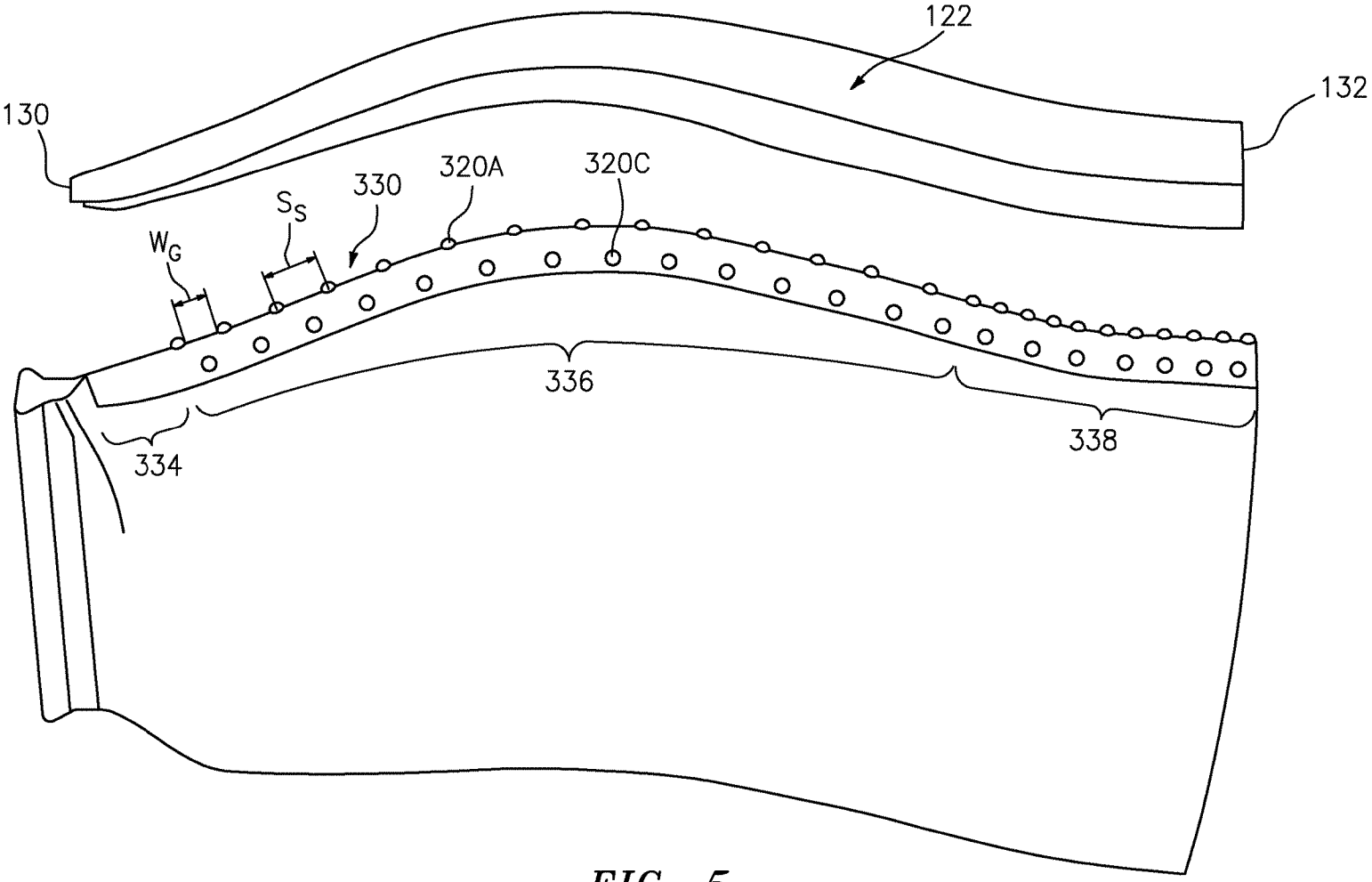
FIG. 5 is a partially exploded view of the blade of FIG. 2.

One or more of the spacer rows may have varying pitch or inter-spacer spacing. FIG. 5 shows inter-spacer spacing labeled as $S_S$ with inter-spacer gaps 330 having span or width $W_G$.

The exemplary airfoil is divided spanwise into three zones: a rootward or inboard zone 334; an intermediate zone 336; and a tipward or outboard zone 338.

In the exemplary embodiment, the rootward zone 334 features no spacers in any of the three exemplary rows. Measured as a percentage of span from the sheath rootward end 130 to the sheath tipward end 132, the extent of the rootward region 334 may be an exemplary 5% to 20%, more particularly 5% to 15%. This empty region 334 provides maximum adhesion/bond strength near the root where loading may be highest. Exemplary radial span is 0.3 m to 1 m, more particularly 0.4 m to 0.8 m.

In the exemplary embodiment, $S_S$ and $W_G$ remain essentially constant for the rows of spacers 320B and 320C throughout the regions 336 and 338. In the row of spacers 320A, exemplary $S_S$, and $W_G$ are essentially constant at a similar value to those of 320B and 320C along the region 336 but have higher density along the region 338. This higher density serves to improve spacing because the channel and leading portion will be relatively thin near the tip to allow the airfoil contour to be relatively thin near the tip. Thus, the sheath near the tip may be more susceptible to deformations which might otherwise adversely affect fit and create the possibility of contact with the airfoil main body. An exemplary span of the region 338 is 10% to 30% of the span between sheath ends 130 and 132, more particularly 12% to 25%. An exemplary span of the region 336 is 50% to 75% of the span between sheath ends 130 and 132.

Exemplary inter-spacer spacing $S_S$ is 0.5±0.13 inch (13±3 mm) for the spacers 320A along the tipward region 338 and 1.0±0.13 inch (25±3 mm) for the other two groups in the region 338 and all three groups in intermediate region 336. More broadly, the exemplary lower density spacing may be 10 mm to 100 mm and the higher density spacing may be less than 75% of the higher density spacing (e.g., 25% to 70%). An alternative involves the higher density for all three rows in the region 338. Exemplary spacer coverage is less than 5% of the joint planform, more particularly less than 1%.

Exemplary spacers 320 are polymeric. Exemplary polymer is polystyrene. Exemplary spacer forms are non-hollow spherical cap portions (e.g., hemispheres) or like feature having a relatively flat first mounting surface and a doubly convex second opposite surface. Exemplary spacers have a radius of 0.5 millimeter, more broadly, 0.2 mm to 1.5 mm or 0.40 mm to 0.80 mm.

In an exemplary assembly sequence, the blade substrate and sheath are already formed by conventional techniques. The adhesive 322 may be applied to one or both of the substrate and sheath. In a first example, it is applied only to the substrate. One exemplary method of adhesive application is as a pre-formed adhesive film (e.g., unsupported).

Exemplary adhesive film 322 is an unsupported thermosetting, modified epoxy adhesive film such as 3M™ Scotch-Weld™ structural adhesive film AF 3109-2U of 3M, St. Paul, Minn. Exemplary initial film thickness is 0.005 inch (0.013 mm).

In the exemplary sequence of manufacture, the spacers are applied to the adhesive after adhesive application. In this example, the relatively flat faces of the hemispheres are applied to the exposed surface of the adhesive film atop the leading portion 160 of the blade substrate. Spacer application may be performed by vacuum tool (e.g., hand held or robotic) to sequentially place individual spacers. After spacer application, the sheath may be assembled to the substrate via conventional means.

Figure 3B:
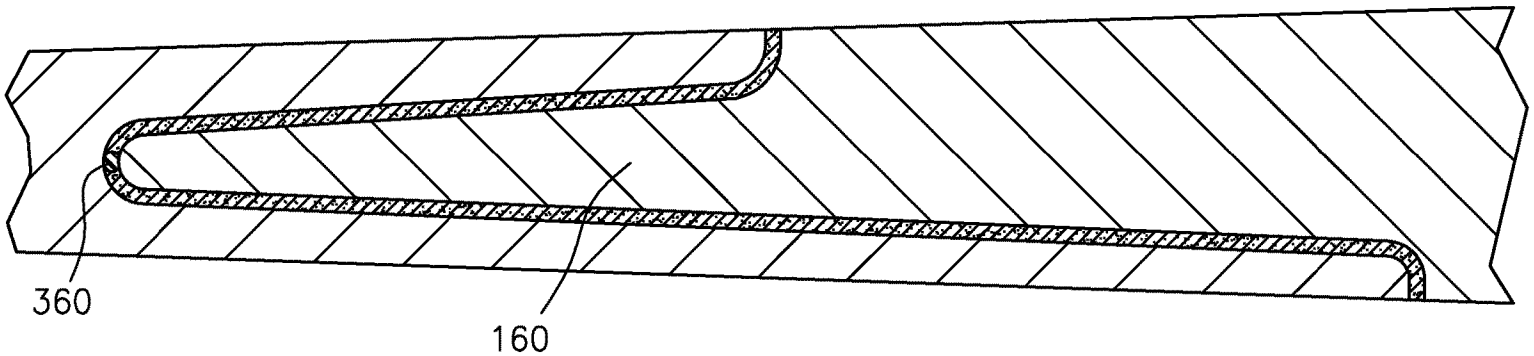
FIG. 3B is an enlarged view of an alternate joint to that of FIG. 3A.
Figure 6:
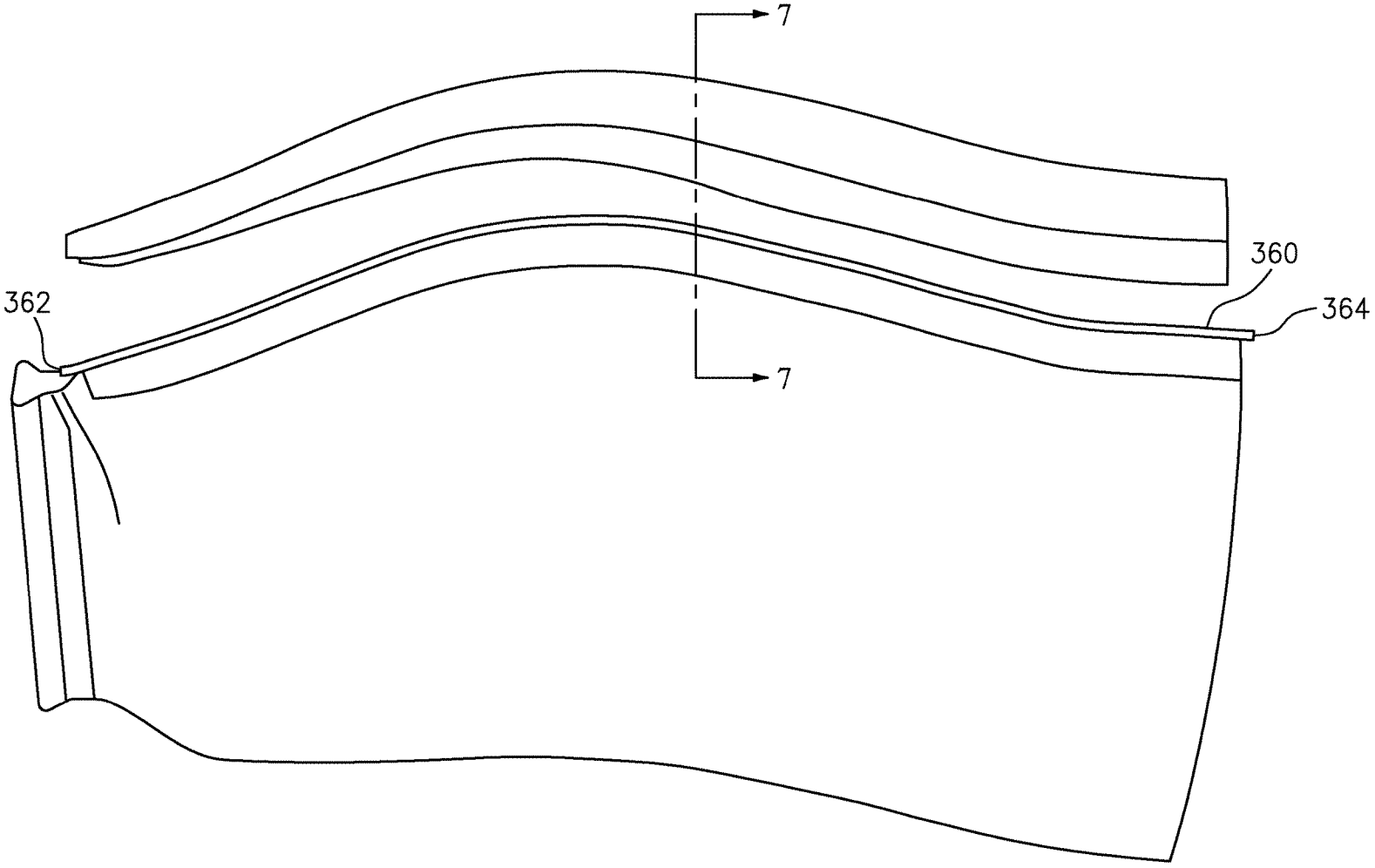
FIG. 6 is a partially exploded view of a blade having the alternate joint of FIG. 3B.
Figure 7:
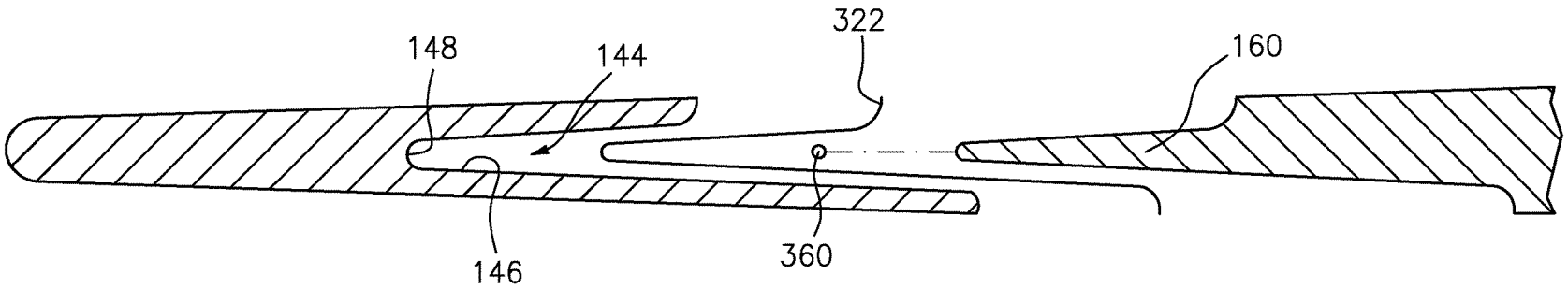
FIG. 7 is an exploded sectional view of the blade of FIG. 6 showing manufacturing features taken along line 7-7.

FIGS. 3B, 6, and 7 show an alternate implementation wherein there is a single spacer 360 between the leading edge 162 of the substrate portion 160 and the base 148 of the channel 144. The spacer 360 extends from an inboard end 362 to an outboard end 364 (FIG. 6).

The exemplary spacer 360 is formed as a cord or rope-like structure of an insulating material such as a glass or polymer. More particularly, an exemplary configuration involves a glass fiber structure such as a thread. An exemplary thread is a twisted glass fiber yarn thread such as available from AGY Holding Corp., Aiken, S.C. as BC-8 E-glass sewing thread, 0.020 inch (0.5 mm) maximum diameter. More broadly, exemplary uncompressed diameters or other thickness measurements are 0.20 mm to 1.5 mm, more particularly 0.30 mm to 1.0 mm.

Assembly techniques may be essentially the same as with the spacers 320, with the spacer 360 being applied atop a layer of adhesive pre-applied to the substrate leading portion. Another alternative shown in FIG. 7 involves applying the spacer 360 to the sheath. For example, the film 322 may be applied to the surface 146 of the channel 144 and, thereafter, the spacer 360 inserted into the channel to adhere to the adhesive along the base 148. Thereafter, the sheath may be assembled to the substrate in conventional manner. In yet other alternatives, an adhesive separate from the film 322 may be used. For example, a very narrow strip of similar adhesive film may be applied to either the edge 162 of the portion 160 or the base 148 of the channel and then the spacer applied thereto. A larger piece of the film covering the full extent (planform) of the substrate-to-sheath interface may then be applied to one or both.

Figure 8:
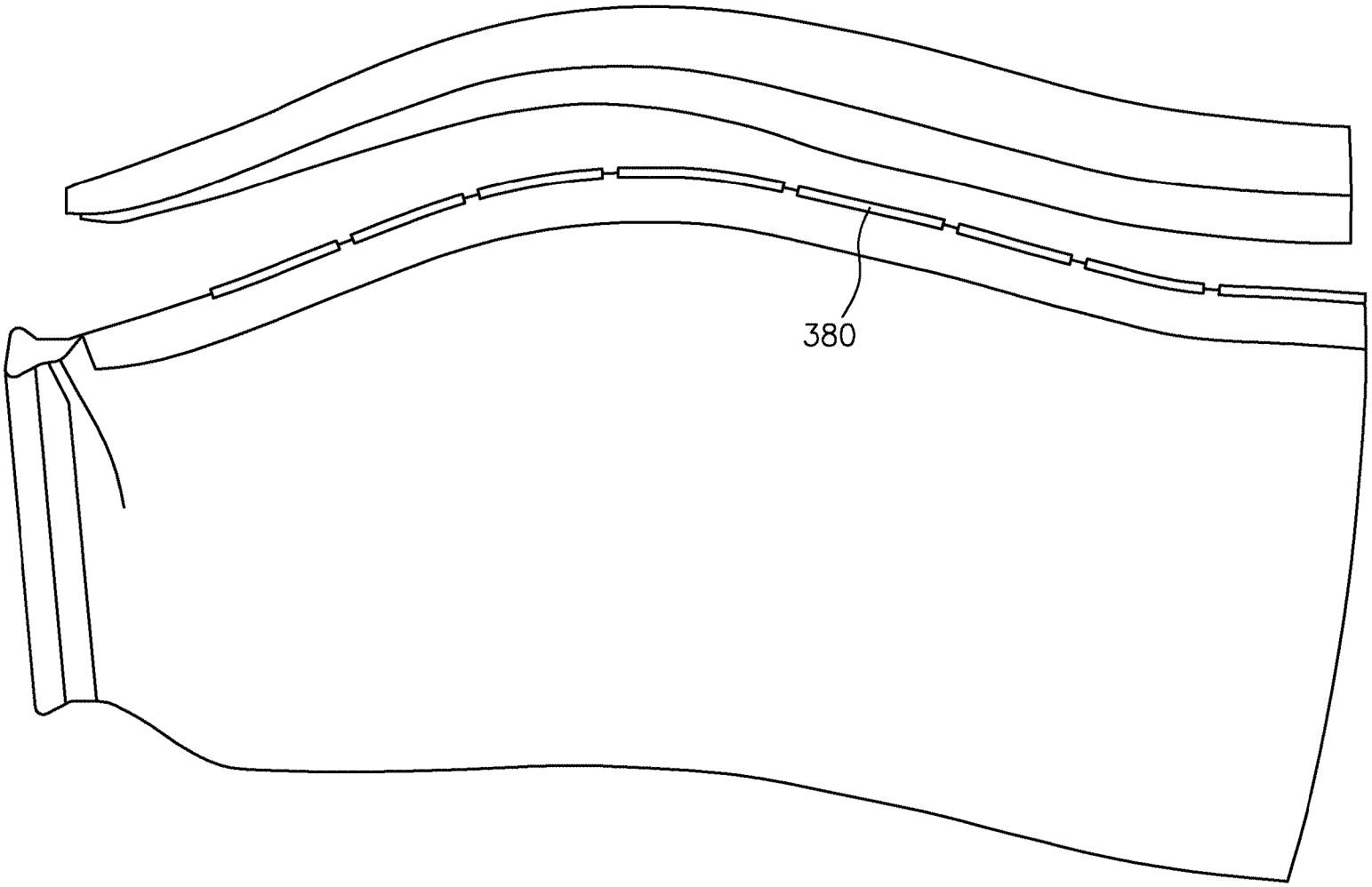
FIG. 8 is a partially exploded view of a blade having a second alternate joint.

FIG. 8 shows a variation on FIG. 6 wherein the spacer 360 is replaced with a series of segments 380 facing end-to-end in a row. These segments 380 may be of similar material to that described above for 360. However, one alternative involves forming them of a more rigid material. The rigidity might make it impractical to bend a single piece to the desired contour. Alternatively or additionally, the rigidity may create stresses from differential thermal expansion. Accordingly, segmentation can address both of these issues. Exemplary rigid material for the spacers 380 is a ceramic such as alumina. Exemplary spacers 380 are of circular cross-section of diameter 0.015 inch (0.38 mm, more broadly 0.15 mm to 1.0 mm or 0.20 mm to 0.7 mm) and have a length of 0.25 inch (6.4 mm, more broadly 2 mm to 30 mm or 4 mm to 15 mm). Exemplary inter-spacer spacing is small (e.g., less than 5 mm, more particularly less than 3 mm or 0.5 mm to 5 mm or 0.5 mm to 2 mm. As with the spacers 320, the inboard or rootward region 334 may be spacer-free.

Figure 9:
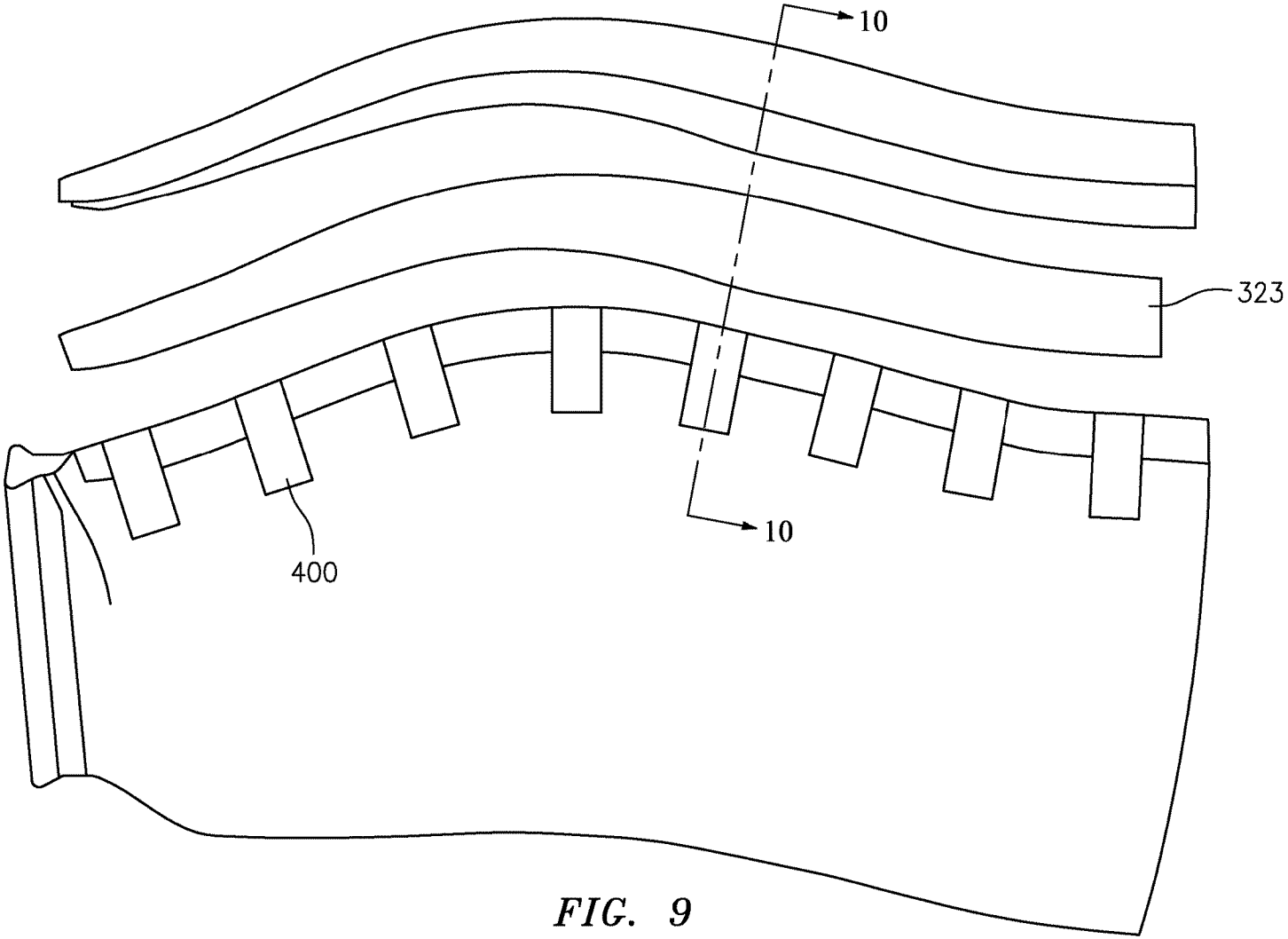
FIG. 9 is a partially exploded view of a blade having a third alternate joint.
Figure 10:
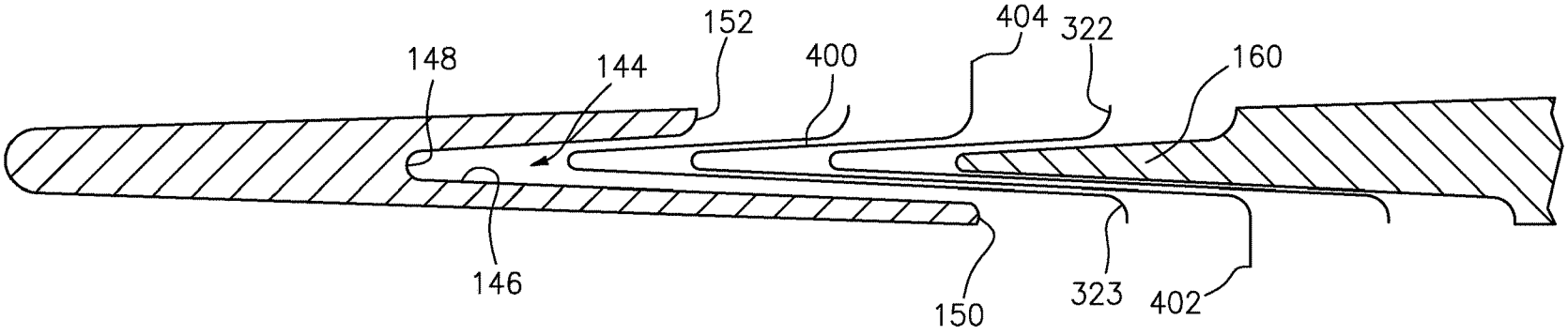
FIG. 10 is an exploded sectional view of the blade of FIG. 9 taken along line 10-10.

FIGS. 9 and 10 show an alternate embodiment wherein spacers 400 are formed as a spanwise array of streamwise oriented strips overarching the leading portion 160.

The exemplary strips 400 have opposite ends 402 and 404 and are dimensioned with sufficient length so that upon initial assembly respective end portions will protrude (e.g., as tabs) beyond the joint on opposite sides of the airfoil. In one implementation, two layers of adhesive are used with a first layer used to initially secure the strips to one of the substrate and sheath and then a second layer ultimately opposite the strips. For example, FIG. 9 shows the adhesive layer 322 applied to the substrate as done with the embodiments above. The strips 400 are then applied to the substrate. A second layer 323 of like adhesive may then be applied over the strips and the sheath then mated to the substrate in conventional manner. As noted above, this leaves tab portions at the ends 402 and 404 of the spacers protruding from the joint along the pressure side and suction side of the main body downstream from the respective shoulders.

Exemplary fiber material for spacers 400 is fabric, more particularly, a woven fabric. Exemplary material is polymeric such as nylon (aliphatic polyamide) or aramid fiber. Exemplary material is a knit nylon supported high temperature modified epoxy film adhesive available as Hysol® EA 9689 AT9154509 from Henkel Corporation, Bay Point Calif. The exemplary fabric thickness is 0.005 inch (0.08 mm) uncured, more broadly 0.002 inch to 0.010 inch (0.05 mm to 0.25 mm). Exemplary strip width is 0.25 inch (6.4 mm, more broadly at least 2mm or 4 mm or 2 mm to 20 mm or 4 mm to 12 mm). In an exemplary embodiment, the strips combine to cover approximately 4% to 50% of the leading edge 162, more particularly 5% to 25%.

Exemplary strip count is four to fifteen per side, more narrowly five to ten. Exemplary strip coverage is less than 50% of the planform of the joint. Although each strip is straight and wrapped normal to the leading edge 162, other arrangements including angling the strips are possible. An exemplary on-center pitch or spacing of the strips is 3.5 inches (9 cm) (more broadly 5 cm to 20 cm or 6 cm to 15 cm) with the inboardmost and outboardmost strips centered 1.0 inch (25 mm) from the associated ends 130 and 132 of the sheath (more broadly up to 30 cm from the inboard end 130 and up to 5 cm form the outboard end 132).

The spacers may help provide galvanic isolation (e.g., allowing for a relatively thick and even epoxy layer in the gaps between spacers).

In exemplary manufacture of each of the aforementioned embodiments, the assembly is shrink wrapped to compress. The wrapped assembly is then bagged and autoclaved to cure. After autoclaving the assembly is debagged/dewrapped and cleaned. Any flash may be removed and any protruding strip tabs or rope end portions cut away.

Relative to a baseline scrim, the use of the spacer(s) may improve spacing by providing a thicker spacer (i.e., the height of the solid spacers or the thread/fabric is greater than the height of the mesh scrim of a scrim-supported film adhesive.

The use of "first", "second", and the like in the following claims is for differentiation within the claim only and does not necessarily indicate relative or absolute importance or temporal order. Similarly, the identification in a claim of one element as "first" (or the like) does not preclude such "first" element from identifying an element that is referred to as "second" (or the like) in another claim or in the description.

Where a measure is given in English units followed by a parenthetical containing SI or other units, the parenthetical's units are a conversion and should not imply a degree of precision not found in the English units.

One or more embodiments have been described. Nevertheless, it will be understood that various modifications may be made. For example, when applied to an existing baseline configuration, details of such baseline may influence details of particular implementations. Accordingly, other embodiments are within the scope of the following claims.

What is claimed is:

1. A airfoil member (100) comprising:
a substrate (120) along at least a portion of an airfoil (102) of the airfoil member;
a sheath (122) having a channel (144) receiving a portion (160) of the substrate and wherein the sheath forms a leading edge (110) of the airfoil; and
a plurality of separate spacers (320; 380; 400) formed as separate pieces between the sheath and the substrate and having a plurality of gaps between the spacers.

2. The airfoil member of claim 1 wherein:
the plurality of separate spacers comprise a plurality of polymeric elements.

3. The airfoil member of claim 1 wherein:
the plurality of separate spacers (380) comprise a plurality of ceramic elements.

4. The airfoil member of claim 1 wherein:
the plurality of separate spacers are distributed in a plurality of rows.

5. The airfoil member of claim 4 wherein:
the plurality of rows comprise a leading edge row, a suction side row and a pressure side row.

6. The airfoil member of claim 1 wherein:
the substrate is a first metallic material; and
the sheath is a second metallic material different from the first metallic material.

7. The airfoil member of claim 6 wherein:
the first metallic material is an aluminum alloy; and
the second metallic material is a titanium alloy.

8. The airfoil member of claim 1 wherein:
there is no mesh scrim between the substrate and sheath.

9. The airfoil member of claim 1 wherein:
the spacers (400) each comprise a fibrous sheet.

10. The airfoil member of claim 1 wherein:
the spacers each comprise aramid fiber or polyamide fiber.

11. The airfoil member of claim 10 wherein:
the aramid fiber or polyamide fiber is formed as a knit sheet.

12. The airfoil member of claim 1 wherein:
the spacers each have a characteristic thickness of 0.15mm to 0.80mm.

13. The airfoil member of claim 1 being a fan blade.

14. A method for manufacturing the airfoil member of claim 1, the method comprising:
applying an adhesive sheet (322) to the substrate or the sheath;
applying the spacers to the adhesive; and
applying the sheath to the substrate.

15. The method of claim 14 wherein:
the spacers are applied sequentially.

16. The method of claim 14 wherein:
the applying of the sheath leaves end portions of the spacers protruding along the substrate.

17. The method of claim 16 further comprising:
cutting off the end portions.

18. A turbine engine comprising the airfoil member of claim 1 as a fan blade.

19. The airfoil member of claim 1 wherein:
the spacers (400) each comprise a fibrous sheet and each of the gaps are between respective edges of two of said sheets.

20. The airfoil member of claim 1 wherein:
the plurality of separate spacers each have a first surface and a second surface, the second surface being convex and the first surface being flatter than the second surface.

21. The airfoil member of claim 1 further comprising:
an adhesive, the plurality of separate spacers comprising a plurality of polymeric elements or ceramic elements in the adhesive.

* * * * *